United States Patent [19]

Nodo

[11] 4,141,119

[45] Feb. 27, 1979

[54] PLASTIC CLIP

[75] Inventor: Taizo Nodo, Nishinomiya, Japan

[73] Assignee: Kohshoh Limited, Kyoto, Japan

[21] Appl. No.: 868,340

[22] Filed: Jan. 10, 1978

[30] Foreign Application Priority Data

Sep. 14, 1977 [JP] Japan ..... 52-111110

[51] Int. Cl.[2] ..... A44B 21/00

[52] U.S. Cl. ..... 24/250

[58] Field of Search ..... 24/250

[56] References Cited

U.S. PATENT DOCUMENTS

| | | | |
|---|---|---|---|
| 687,177 | 11/1901 | Caldwell | 24/250 |
| 736,170 | 8/1903 | Stuver | 24/250 |
| 754,194 | 3/1904 | Buchanan | 24/250 |
| 872,297 | 11/1907 | Krause | 24/250 |
| 1,055,552 | 3/1913 | Payne | 24/250 |
| 3,780,402 | 12/1973 | Takabayashi | 24/250 |
| 3,881,228 | 5/1975 | Takabayashi | 24/250 |
| 3,914,828 | 10/1975 | Noda | 24/250 |
| 4,005,510 | 2/1977 | Noda | 24/250 |

*Primary Examiner*—Bernard A. Gelak

[57] ABSTRACT

A plastic clip comprises an upper and lower clip members having clipping portions respectively for clipping an article to be clipped therebetween, an operative member for change the clipping portions of the upper and lower clip members between the open and closed positions and a resilient member for biasing the clipping portions of the upper and lower clip members into the open position.

6 Claims, 9 Drawing Figures

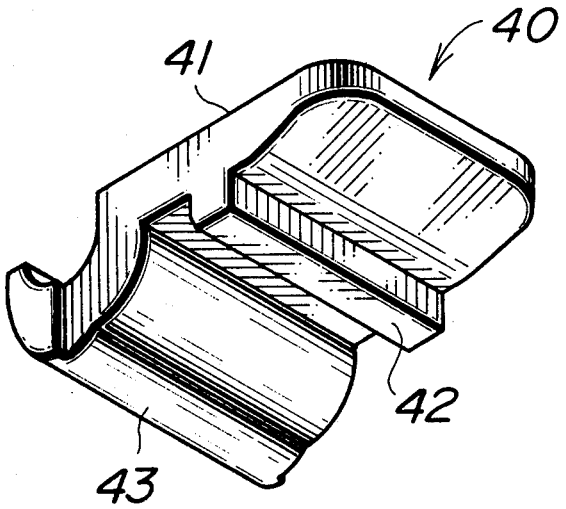
FIG. 4
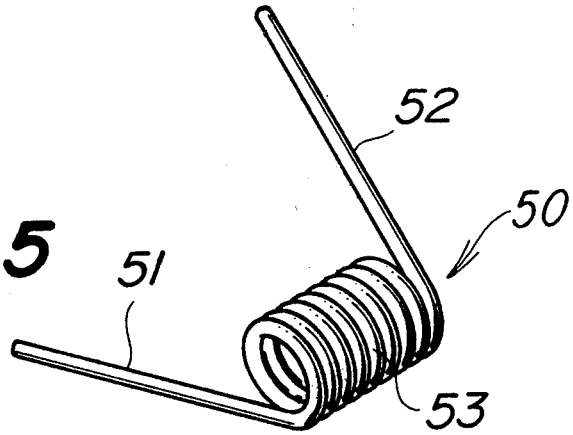
FIG. 5
FIG. 6
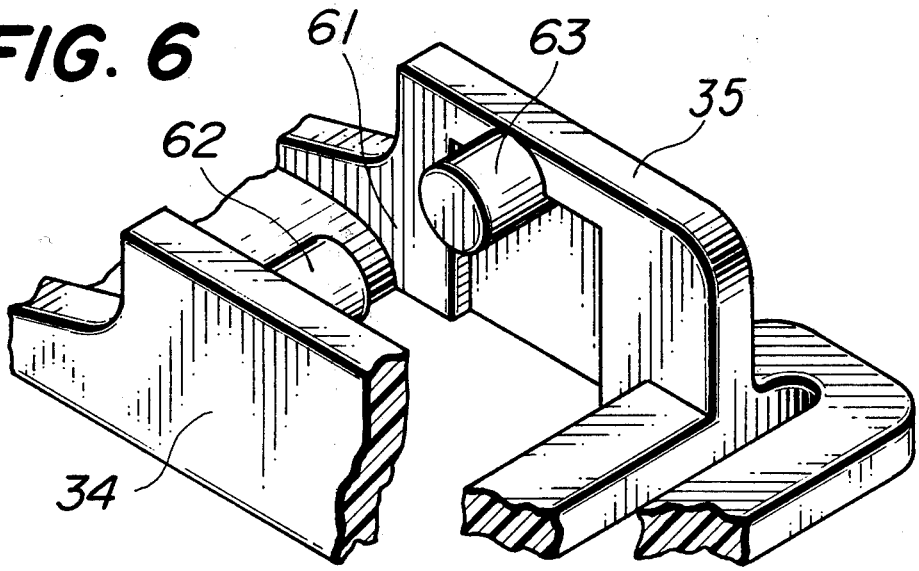

PLASTIC CLIP

The present invention relates to a clip for use for example, on suspenders, belts and the like, or as laundry clips, paper clips and the like.

As such kinds of clips, ones made of metal or resin capable of integrally forming the same are well known. A metal clip is inferior to a clip formed of resin in its easiness to manufacture, durability and touch. Therefore, except for special purposes, such kinds of clips are generally formed of resin or plastic material.

A plastic clip is, however, inferior to a metal one in its clipping force and strength of its own. To eliminate these disadvantages, it may be proposed to make each member of a clip larger in thickness, but only thickening each member makes the clip itself thick and large in size, resulting in unfaborableness in its touch and appearance.

A plastic clip generally comprises a substantially flat upper and lower clip members, an operative member for opening and closing the clipping portions of the upper and lower clip members and a resilient member for setting the clipping portions in the open position. The upper and lower clip member are opposed in parallel and connected with each other by means of a pivot mechanism functioning as a supporting point of a lever. One longitudinal end portion of each of the upper and lower clip members i.e. the clipping portion functions as a point of application, and the other end portion as a point of force. To this point of force, a force from the operative member mounted between the upper and lower clip members is applied. The clipping force of a clip in which a point of application, a supporting point and a point of force are arranged in this order relates substantially to an opposite pressing force generated at the clipping portions by the effect of a lever and the friction numbers of the clipping portion surfaces and the surface of an article clipped. Especially when a clip is formed of plastic material i.e. the upper and lower clip members are not rigid but resilient, part of the opposite pressing force is consumed in deforming the upper and lower clip members. Therefore, the upper and lower clip members are so deformed as to form arcs apart from each other through the part from the pivot mechanism to the clipping portion. Thus, the substantial pressing force obtained at the clipping portions is that obtained by deducting the deforming force from the originally generated force. As the result, in order to eliminate such a loss of force and to efficiently transmit the force obtained at the point of force by means of the operative member to the clipping portions, it is preferable to make the upper and lower clip members so thick and substantially rigid as to bring as little curving deformation as possible. However, it is not necessary to make the upper and lower clip members uniformly thick throughout their lengths, and this is unpreferable because of resulting in unfaborable touch and appearance. Consequently, by making the upper and lower clip members gradually thicker from the clipping portion to the pivot mechanism, the members even of plastic material can function as rigid ones and a large clipping force can be obtained since the opposite pressing force is not consumed in deforming the upper and lower clip members.

In order to make a clip itself as small in thickness as possible and to make the distance between the clipping portions in the open position as large as possible, it is preferable to change the arrangement of a point of application, a supporting point and a point of force. Namely, by arranging a point of application, a supporting point and a point of force in this order, the distance between the clipping portions in the open position is limited by the contact between the upper and lower clip members on the side of the operative member provided. Instead of this, by arranging a point of application, a point of force and a supporting point in this order, such a limitation is eliminated. In this case, the operative member provided at the point of force causes the closing operation of the clipping portions in such a manner as to bring the upper and lower clip members near to each other.

The present invention is brought in view of the abovementioned points. And one object of the present invention is to provide a plastic clip in which a desired strength and clipping force can be obtained without make the clip large in thickness thereof.

Another object of the present invention is to provide a plastic clip in which the pivotal movement of an operative member which brings an opening and closing movement of clipping portions can be smoothly carried out.

A further object of the present invention is to provide a plastic clip in which the distance between clipping portions in the open position is so large that the clip can clip a thick article.

A further object of the present invention is to provide a plastic clip which is small in its whole thickness and therefore and excellent in its touch.

In a clip according to the present invention, an upper clip member comprises a substantially flat main plate, a wall extended downwardly from the rear end portion of the main plate, and a subplate extended from the lower end portion of the wall rearwardly and substantially in parallel with the main plate. And a lower clip member in the clip comprises a substantially flat plate and a pair of bearing portions integrally extended upwardly from both sides of the rear portion of the plate, and there is also provided at the upper portion of the bearing portions a pivotal element which projects across the plate and has an arched lower surface. Further, the lower clip member has an opening in the rear portion of the plate into which the subplate of the upper clip member is located. Further, at the rear end portion of the subplate, there is provided an engaging portion which can engage with the rear edge of the opening of the lower clip member.

An operative member in a clip according to the present invention has an arm or operative lever comprising a substantially flat plate and a receiving element extended from the operative lever. The receiving element engages with the pivotal element of the lower clip member to bring a pivotal connection. Further, the lower surface of the receiving element is adapted as a sliding surface which slides on the upper surface of the subplate of the lower clip member. Between the upper and lower clip members, a resilient member is mounted which can sets the clipping portions of the clip in the open position. Each of the upper and lower clip members and the operative member is integrally formed of plastic material e.g. preferably polycarbonate and polyacetal material, while the resilient member is formed of metal e.g. spring steel, rubber or said plastic material.

Now, an embodiment of a clip accoridng to the present invention will be described with reference to the appended drawing. From this description, the abovementioned and other objects and features of the present invention will be easily understood.

FIG. 4 is a perspective view of an operative member of the clip according to the present invention;

FIG. 5 is a perspective view of a resilient member of the clip according to the present invention;

FIG. 6 is a perspective view of a modification of the lower clip member of the clip according to the present invention;

Figure 1:
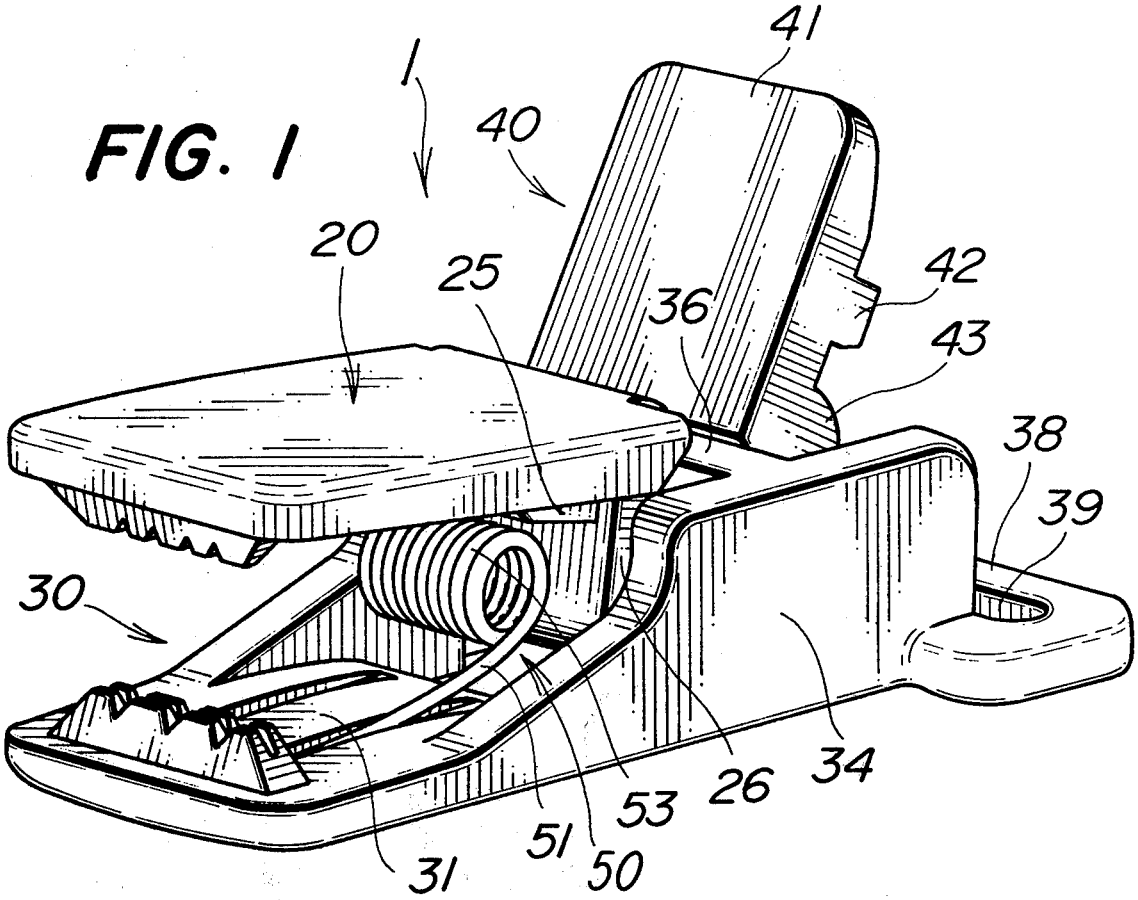
FIG. 1 is a perspective view of a plastic clip according to the present invention.
Figure 2:
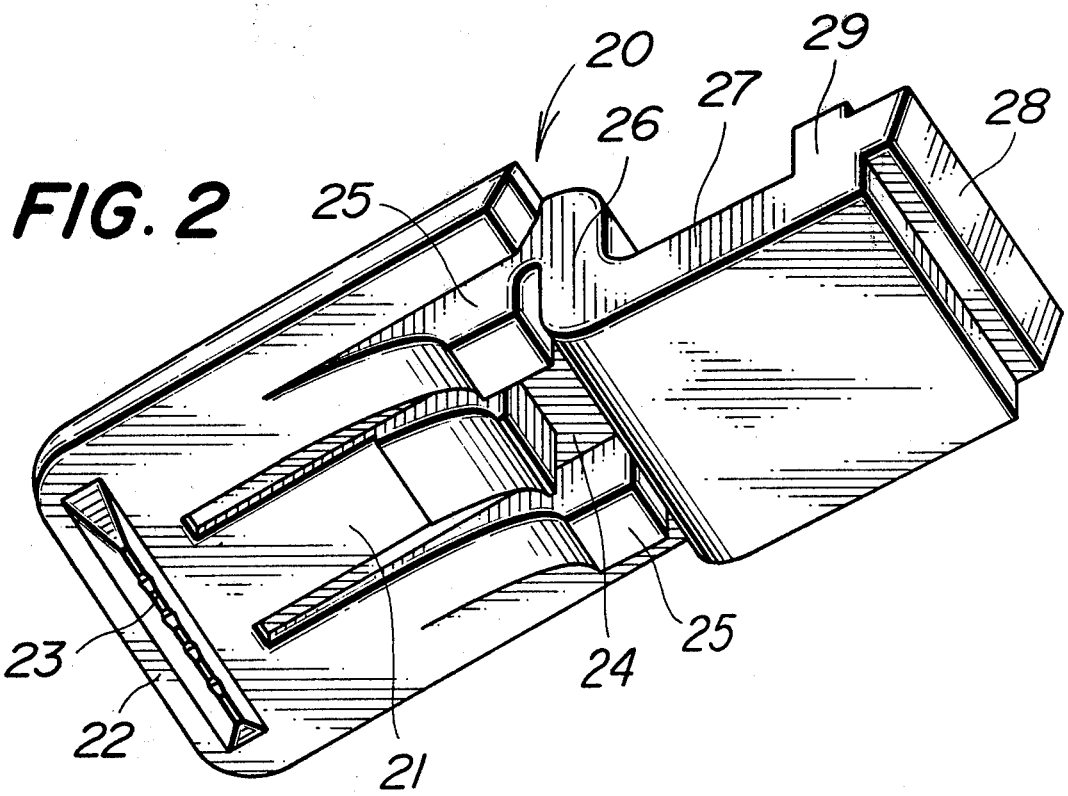
FIG. 2 is a perspective view of an upper clip member of the clip according to the present invention.

As seen from FIGS. 1 and 2, an upper clip member 20 has a substantially flat and rectangular main plate 21. The lower surface of the front portion of the plate 21 is a clipping portion 22. On the clipping portion 22, an antislipping member 23 is provided which has projections each wedge-shaped in section. The antislipping member 23 may be either formed of rubber and attached to the clipping portion 22, or formed integrally with the plate 21. On the lower surface of the rear portion of the plate 21, a projection 25 is integrally formed with the plate 21 which defines a recess 24 into which a resilient member 50 is mounted. The projection 25 also functions as a reinforcement part for protecting the plate 21 against the curving deformation. Further, the upper clip member 20 has a wall 26 extended downwardly from the rear end portion of the plate 21 and a subplate 27 extended from the lower end portion of the wall 26 rearwardly and substantially in parallel with the plate 21. The angle between the wall 26 and the plate 21 is preferably selected less than 90°. The rear end 29 of the subplate 27 projects upwardly and substantially in parallel with the wall 26. Further at this upwrad projection, a engaging portion 28 integrally protrudes from the end face of the projection rearwardly and substantially in parallel with the subplate 27. The rear end wall 29 is extended a little above the engaging portion 28 and terminates there.

Figure 3:
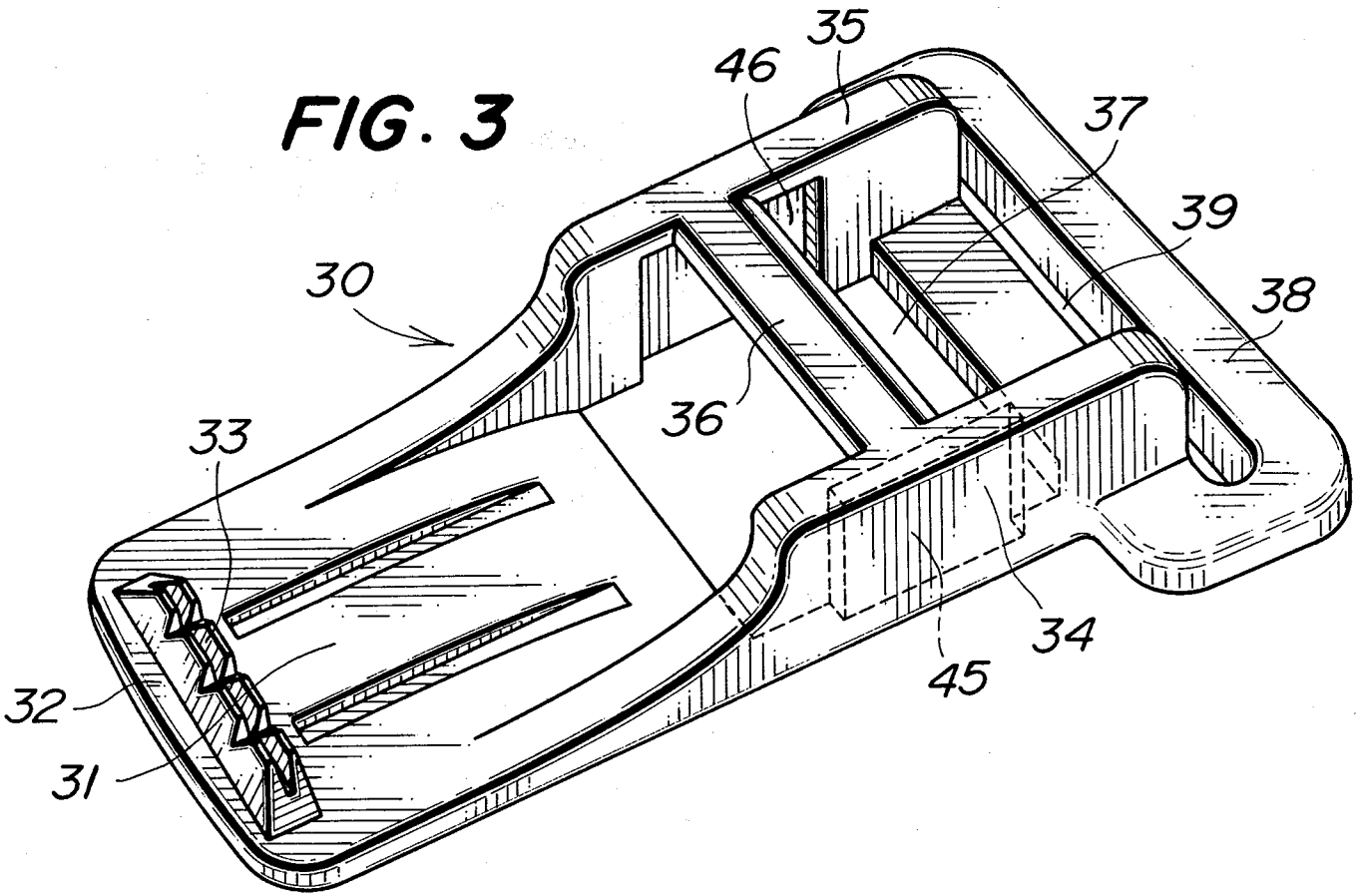
FIG. 3 is a perspective view of a lower clip member of the clip according to the present invention.
Figure 8:
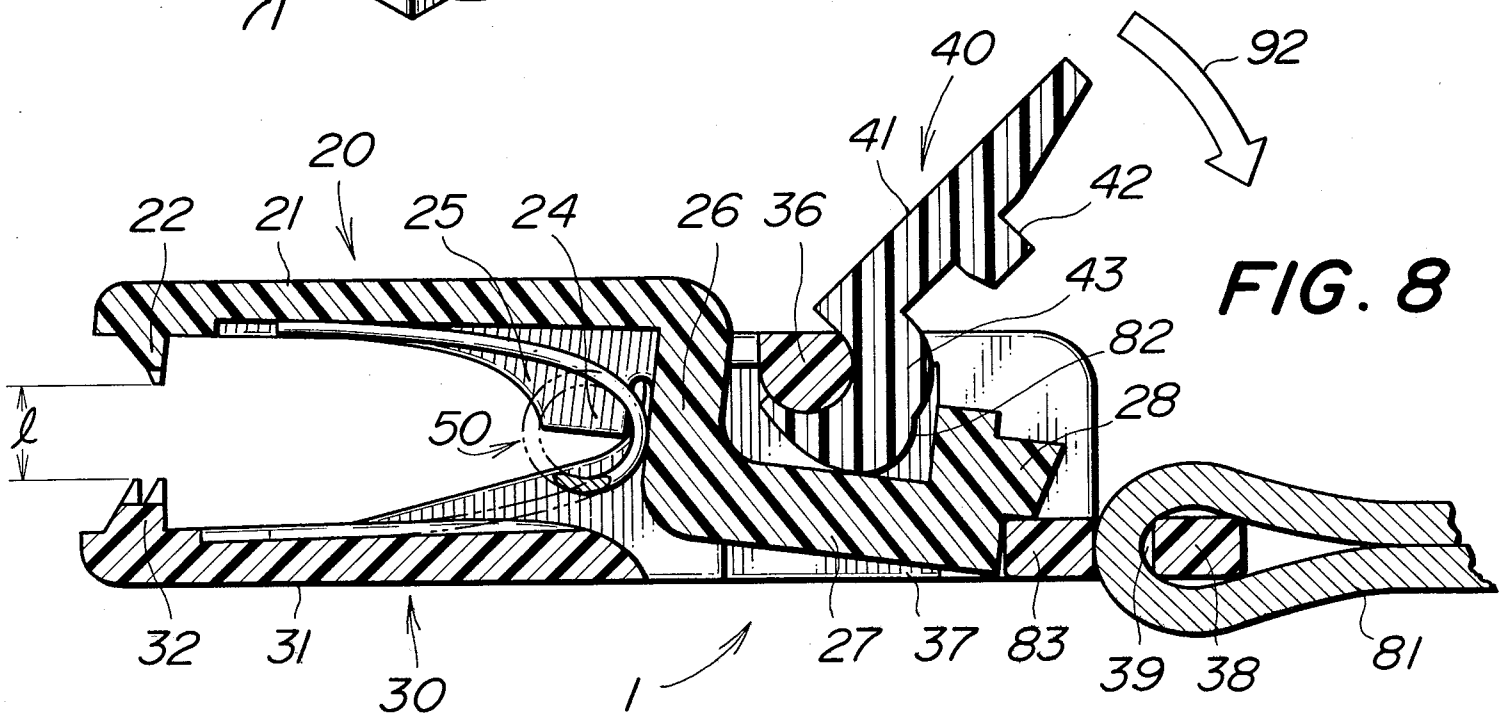
FIG. 8 is a sectional view of a plastic clip according to the present invention in which the clipping portions are in the open position.
Figure 9:
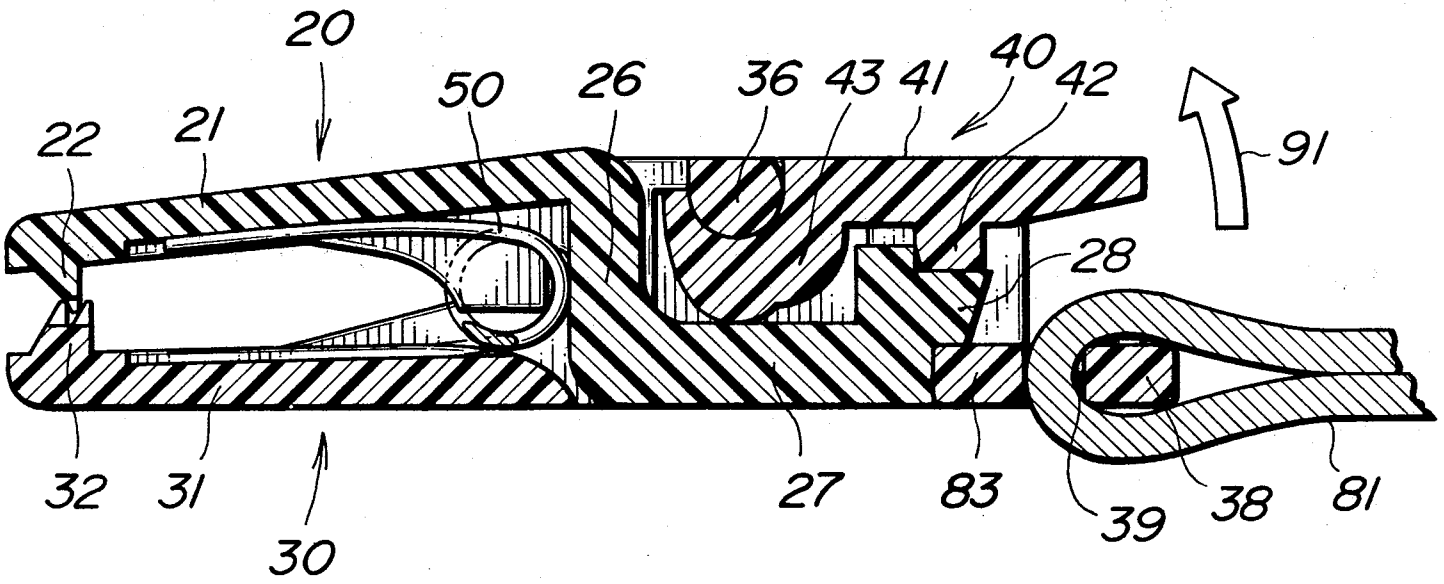
FIG. 9 is a sectional view of the plastic clip according to the present invention in which the clipping portions are in the closed position.

As seen form FIGS. 1 and 3, the lower clip member 30 ahs a substantially flat and straight plate 31. The front portion of the plate 31 is a clipping poriton 32. On the clipping portion 32, there is provided an antislipping member 33 substantially the same as the member 23. Further, the lower clip member 30 has a pair of bearing portions 34, 35 projected upwardly from either side of the plate 31. Preferably, the bearing portions is so formed that their heights gradually increases from the front portion i.e. the clipping portion 32 to the rear portion. At the uper portion, preferably upper end of the bearing portions 34, 35 there is provided a pivotal element 36 perpendicular to the length of the plate 31. Suitably, the pivotal element 36 is formed in a semicylindrical shape and located with the circular surface thereof facing downward. Alternatively, the pivotal element may be formed in a cylinder connecting the bearing portions 34, 35 as a bridge. Instead of as such a bridge, the pivotal element 36 may be formed as a pair of projections 62, 63 opposed with a space 61 therebetween as shown in FIG. 6. In the rear portion of the plate 31 there is provided an opening 37. The subplate 27 of the upper clip member 20 is adapted to be inserted into the opening 37, so that the clip 1 can be formed substantially small in thickness thereof. The rear portion of the plate 31 is enlarged in the lateral direction and defines a belt engaging portion 38. The belt engaging portion 38 is required when the clip is used on a suspender or the like and in this case there is provided a laterally extended opening 39 which one end of a belt 81 (as shown in FIGS. 8 and 9) is passed through and engaged with. Alternatively, when the clip is used simply as a paper clip, such a belt engaging portion 38 having the opening 39 is not required. In this case, the rear portion of the plate 31 is so formed as to close the opening 37 i.e. to define the rear side of the opening 37. Further, on the inner surfaces of the pair of the bearing poritons 34, 35, there are provided recesses 45, 46 allowing a loose fitting for pivotal movement.

Figure 7:
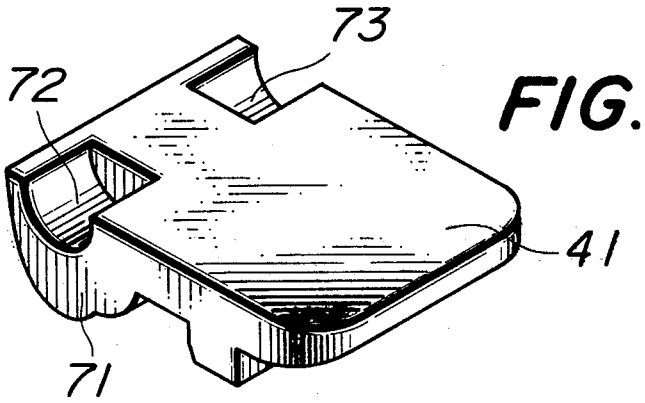
FIG. 7 is a perspective view of a modification of the operative member of the clip according to the present invention.

As seen from FIGS. 1 and 4, an operative member 40 has a substantially flat plate 41. The plate 41 constitutes an operative arm or operative lever which, when pivotally moved, provides the second lever effect in the opening and closing movement of the clipping poritons. On the lower surface of the plate 41 an engaging portion 42 is provided which is projected downwardly. The engaging portion 42 is adapted to come into contact with the upper surface of the projection or the engaging portion 28 of the upper clip member. Further, the operative member 40 has a cylindrical receiving element 43 integrally extended forwardly from the front end of the plate 41. The receiving element 43 is adapted to receive the pivotal element 36 of the lower clip member 30 for engagement therewith and provide a pivotal connection therebetween. The receiving element 43 may be formed so as to have a uniform thickness as a whole or gradually increased thickness from the front end toward the substantially central portion. Further, rearwardly from this central portion, the receiving element 43 may have a gradually decreased thickness so that in the pivotal movement of the operative member 40 for closing the clipping portions, firstly a largest pressing force can be applied between the clipping portions and then by a little pivotal movement a somewhat less pressing force can be applied therebetween. In this case, the pivotal movement of the operative member 40 has only to be so limited that a final pressing force can be obtained by the contact of this part having decreased thickness of the element 43 with the pivotal element 36 and the subplate 27. If the pivotal element 36 of the lower clip member 30 comprises the projections 62, 63 as shown in FIG. 6, the receiving element 43 of the operative member 40 may be formed as a semicylindrical receiving element 71 as shown in FIG. 7. In this case, in both of the end portions of the upper surface and at the same time substantially in the center of the sides of the receiving element 71, a pair of laterally elongated semicylindrical recesses 72, 73 are provided. The two sides of the receiving element 43 of the operative member 40 is fitted in the recesses 45, 46 of the lower clip member 30. Further, instead of the belt engaging portion 38 of the lower clip member 30, a similar portion may be provided in the operative arm 41 of the operative member 40.

In FIG. 5, there is shown a resilient member 50 comprising a pair of extended end portions 51, 52 and a coil portion 53 located the extended end portions. The resilient member 50 is mounted in a space defined between the upper and lower clip members and adapted to bring the clip 1 in the open position. In this case, the coil portion 53 is fitted into a recess 24.

The operation of the clip 1 will be now described with reference to FIGS. 1, 8 and 9.

By pivotally moving the operative arm 41 of the operative member 40 about an axis passing through the pivotal element 36 in the direction of an arrow 91, the clipping portions 22, 32 of the upper and lower clip members respectively become apart by means of the resilient member 50. Thereby a distance l is provided between the clipping portions 22, 32 in the open position. Then by downwardly moving the operative arm 41 in the direction of the arrow 92, the clipping portions come close to each other against the resilient force by the resilient member 50. In this case, the arched lower surface 82 of the receiving element 43 make a sliding movement on the upper surface of the subplate 27. Since the sliding surface 82 is formed in such an arched shape, the operative member can provide a smooth pivotal movement. Further, contacting points between the sliding surface 82 and the upper surface of the subplate 27 and between the arched lower surface of the pivotal element 36 and the arched upper surface of the receiving element 43 function as points of force of the clip itself. Thus, to the point of force on the upper clip member 20 a donwwardly directed force is provided by the operative member 40 while to taht point on the upper clip member 20 an upwardly directed force is provided by the member 40. A supporting point comprises a contacting point between the lower surface of the projection 28 and the upper surface of the front end portion 83 of the elongated plate 38. When the operative arm 41 has been pivotally moved till it is substantially in parallel with the lower clip member 30, the lower surface of the projection 42 comes against the upper surface of the engaging portion 28. In this condition, the upper and lower clip members 22, 32 are in close contact with each other to provide a predetermined clipping force for an article to be clipped. The pressing force constituting this clipping force is obtained by means of the receiving element 43 inserted between the pivotal element 36 and the subplate 27. Namely, since the pivotal element 36, the subplate 27 and the receiving element 43 are formed of resilient material, their restitution force can provide the substantial clipping force. Each of the upper and lower surfaces of the clip 1 in such a closed position are substantially flat.

What is claimed is:

1. A plastic clip comprising upper and lower clip members having clipping portions for clipping an article therebetween, an operative member for moving the clipping portions of the upper and lower clip members between open and closed positions, and a resilient member for biasing the clipping portions of the upper and lower clip members into the open position, the lower clip member comprising:

a substantially flat plate having a rear portion and a pair of sides, the rear portion having an opening therethrough, a pair of supporting portions integrally extended upwardly from both sides of the rear portion of the plate, and a pivotal element at the upper portion of each supporting portion which projects toward the other supporting portion and in which at least the lower surface is arched, the upper plate member comprising:

a main plate having a rear end, a wall extending downwardly from the rear end portion of the main plate, and a subplate extending from the lower end portion of the wall rearwardly and substantially parallel with the main plate, the subplate being positioned in the opening of the lower clip member and having at its rear end portion an engaging portion engageable with the rear edge of the opening of the lower clip member, the operative member comprising:

an operative arm and a receiving element provided at the front portion of the arm which engages the pivotal elements of the lower clip member to provide a pivotal connection therebetween, the lower surface of the receiving element engaging the upper surface of the subplate of the upper clip member and functioning as a sliding surface slidable at least on the upper surface of the subplate, the front portion of the receiving element being located in the space defined between the wall of the upper clip member and the pivotal elements.

2. A plastic clip as claimed in claim 1, in which each of the pivotal elements is formed in a semicylindrical shape and are joined to form a bridge, the receiving element being formed in a semicylindrical shape and having a laterally extended recess.

3. A plastic clip as claimed in claim 2, in which the thickness of the receiving element gradually decreases from its central portion toward both its front and rear end portions so that during pivotal movement of the operative member for closing the clipping portions the pressing force applied between the clipping portions varies.

4. A plastic clip as claimed in claim 1, in which each of the pivotal elements comprises a separate projection, the receiving element being formed in a semicylindrical shape and having at least one laterally extending recess.

5. A plastic clip as claimed in claim 4, in which the thickness of the receiving element gradually decreases from its central portion toward both its front and rear end portions so that during pivotal movement of the operative member for closing the clipping portions the pressing force applied between the clipping portions varies.

6. A plastic clip as claimed in claim 1, in which the engaging portion of the upper clip member comprises a projection provided on the rear surface of the rear end wall extending from the rear end portion of the subplate upwardly and substantially parallel with the wall.

* * * * *